US006793423B1

(12) United States Patent
Saito et al.

(10) Patent No.: US 6,793,423 B1
(45) Date of Patent: Sep. 21, 2004

(54) PRINTER

(75) Inventors: Noriyuki Saito, Hyogo (JP); Masayoshi Komori, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 198 days.

(21) Appl. No.: 09/889,768

(22) PCT Filed: Oct. 20, 2000

(86) PCT No.: PCT/JP00/08169

§ 371 (c)(1),
(2), (4) Date: Oct. 19, 2001

(87) PCT Pub. No.: WO01/38214

PCT Pub. Date: May 31, 2001

(30) Foreign Application Priority Data

Nov. 19, 1999 (JP) ..... 11-329514

(51) Int. Cl.[7] ..... B41J 11/70
(52) U.S. Cl. ..... 400/621; 400/611; 101/93.07
(58) Field of Search ..... 400/621, 621.1, 400/621.2, 611, 613; 101/93.07

(56) References Cited

U.S. PATENT DOCUMENTS 5,620,544 A 4/1997 Cram et al.
5,690,774 A * 11/1997 Greene ..... 156/269
5,833,380 A 11/1998 Hosomi et al.
5,904,085 A * 5/1999 Onishi et al. ..... 83/479
6,089,136 A * 7/2000 Hinojosa et al. ..... 83/453
6,102,596 A * 8/2000 Komori et al. ..... 400/621
6,155,731 A * 12/2000 Bertalan et al. ..... 400/621
6,343,884 B1 * 2/2002 Watanabe et al. ..... 400/621
6,361,231 B1 * 3/2002 Sato et al. ..... 400/621
6,443,645 B1 * 9/2002 Takei et al. ..... 400/621
6,508,600 B1 * 1/2003 Nonaka ..... 400/621
6,565,273 B2 * 5/2003 Yamada ..... 400/512

FOREIGN PATENT DOCUMENTS

JP 07125887 5/1995
JP 8-141980 4/1996
JP 08206990 8/1996
JP 3096702 8/2000

* cited by examiner

*Primary Examiner*—Andrew H. Hirshfeld
*Assistant Examiner*—Dave A. Ghatt
(74) *Attorney, Agent, or Firm*—RatnerPrestia

(57) ABSTRACT

The present invention simplifies the operation to set the printing sheet in the printer. The present invention includes main body, storage space for printing sheet, which is disposed in the main body and having a top opening, cover which is installed at the top opening of the storage space and can be freely opened and closed, printing sheet stored in the storage space, sheet outlet port formed between the opening end of the cover and the storage space wall opposing thereto, printing section disposed below the sheet outlet port, and sheet cutting means disposed below the printing section, wherein the sheet cutting means includes stationary blade disposed on the opening end of the cover located below the printing section, and movable blade disposed on the main body portion opposing to the stationary blade.

8 Claims, 4 Drawing Sheets

PRINTER

THIS APPLICATION IS A U.S. NATIONAL PHASE APPLICATION OF PCT INTERNATIONAL APPLICATION PCT/JP00/08169.

TECHNICAL FIELD

The present invention relates to a printer.

BACKGROUND ART

A conventional printer comprises a main body, a storage space for printing sheet, which is disposed in the main body and having a top opening, a cover which is installed at the top opening of the storage space and can be freely opened and closed, a printing sheet stored in the storage space, a sheet outlet port formed between the opening end of the cover and the storage space wall opposing thereto, a printing section disposed below the sheet outlet port, and a sheet cutting means disposed below the printing section.

The problem of the conventional printer is that the operation to set the printing sheet is complicated.

That is, in the sheet cutting means of the conventional printer, both of a stationary blade and a movable blade are installed at the main body side. Accordingly, when setting the printing sheet, it is necessary to pull the end of the printing sheet out of the sheet outlet and, after that, to let the printing sheet pass between the stationary blade and the movable blade below the printing section. Particularly, since the gap between the stationary blade and the movable blade is very narrow, the operation to pass the printing sheet between the stationary blade and the movable blade is troublesome.

SUMMARY OF THE INVENTION

The present invention is intended to simplify the printing sheet setting operation.

In order to achieve the purpose, the printer of the present invention has a sheet cutting means which comprises a first cutting blade installed at the opening end of the cover located below the printing section, and a second cutting blade installed at the main body portion opposing to the first cutting blade.

As is seen in this configuration, since the first cutting blade of the sheet cutting means is disposed at the opening end of the cover, the printing sheet is stored in the storage space, and the end of the printing sheet is brought out of the sheet outlet port until at least reaching the printing section before closing the cover. In this way, the first cutting blade disposed on the cover is opposed to the second cutting blade at the main body side, thereby composing the sheet cutting means. Accordingly, it is possible to simplify the operation to set the printing sheet.

BEST MODE FOR CARRYING OUT THE INVENTION

One embodiment of the present invention will be described in the following with reference to the drawings.

Figure 1:
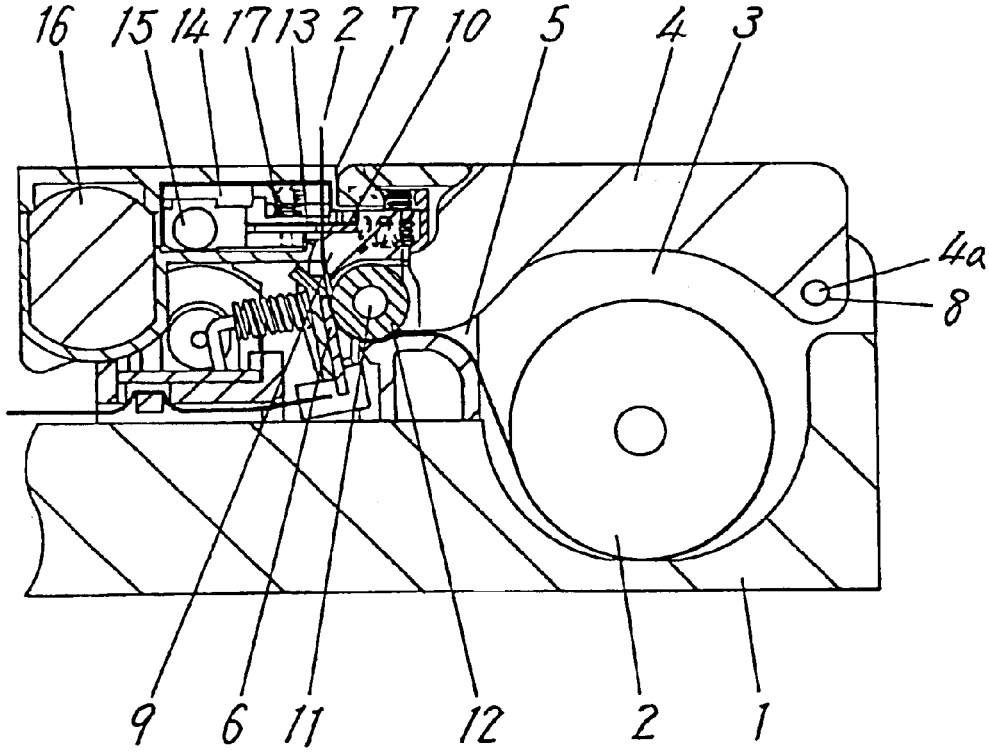
FIG. 1 is a sectional view of essential parts of the printer in one embodiment of the present invention.

As shown in FIG. 1, the printer of the present embodiment comprises a main body 1, a storage space 3 for printing sheet 2, which is disposed in the main body 1 and having a top opening, a cover 4 which is installed at the top opening of the storage space 3 and can be freely opened and closed, a sheet outlet port 5 formed between the opening end of the cover 4 and the storage space wall opposing thereto, a printing section 6 disposed below the sheet outlet port 5, and a sheet cutting means 7 disposed below the printing section 6.

The storage space 3 is concavely formed by the main body 1, and there is provided the cover 4 thereabove.

Figure 2:
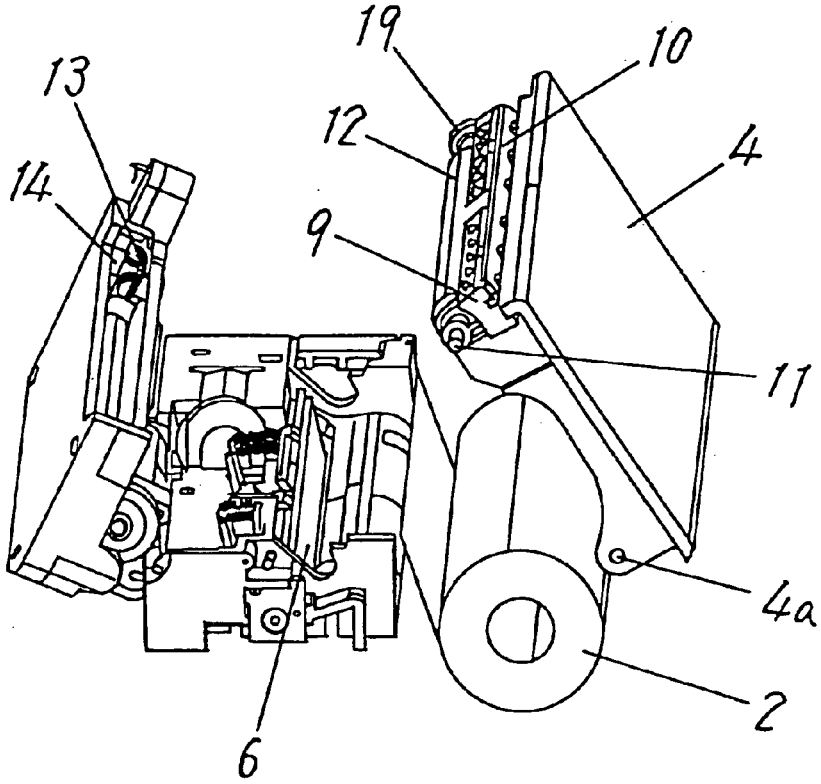
FIG. 2 is a perspective view of essential parts of the printer shown in FIG. 1.
Figure 3:
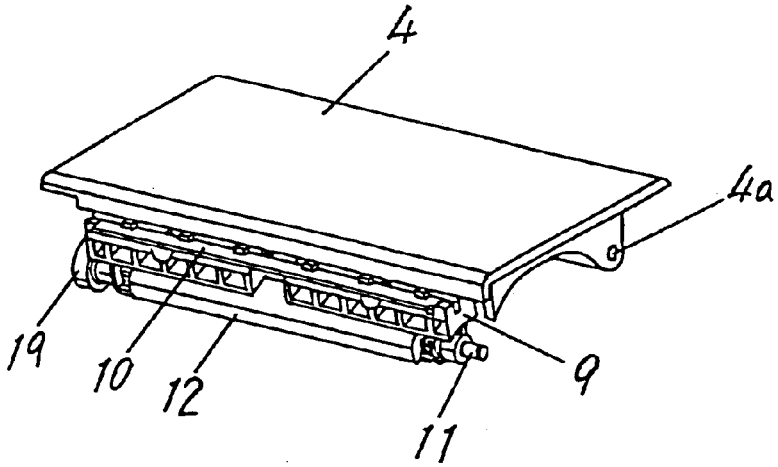
FIG. 3 is a perspective view of the cover of the printer shown in FIG. 1.

The cover 4 has a shaft hole 4*a* at the bottom right portion of the cover as shown in FIG. 2 and FIG. 3. By a shaft 8 of FIG. 1 inserted Into the shaft hole 4*a*, the cover 4 is disposed at the top opening of the storage space 3 and can be freely opened and closed.

Figure 4:
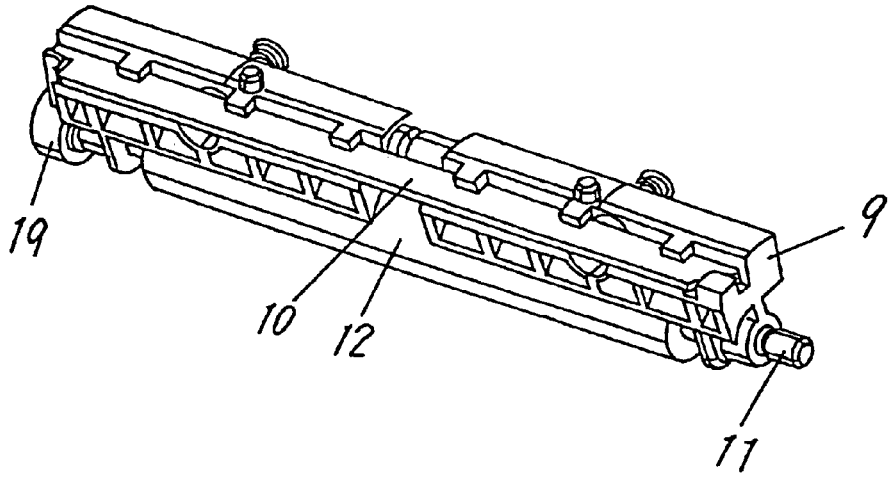
FIG. 4 is a perspective view of the mounting frame attached to the cover of the printer shown in FIG. 1.

Also, a mounting frame 9 shown in FIG. 4 is installed at the bottom left of the cover 4, and a stationary blade 10 as a first cutting blade protruding to the left is disposed at the upper part of the mounting frame 9. Also, a cylindrical platen roller 12 is rotatably disposed by a shaft 11 at the lower part of the mounting frame 9.

Also, when the cover 4 is closed as shown in FIG. 1, a thermal head as the printing section 6 is located opposing to the platen roller 12.

And a movable blade 13 as a second cutting blade composing the sheet cutting means 7 is disposed together with the stationary blade 10 above the printing section 6.

A mounting frame 14 for the movable blade 13 is engaged with a screw thread 15 shown in FIG. 1, and the screw thread 15 is rotated in one direction by motor 16, then the movable blade 13 makes a reciprocal motion in the groove provided in the surface.

Figure 5:
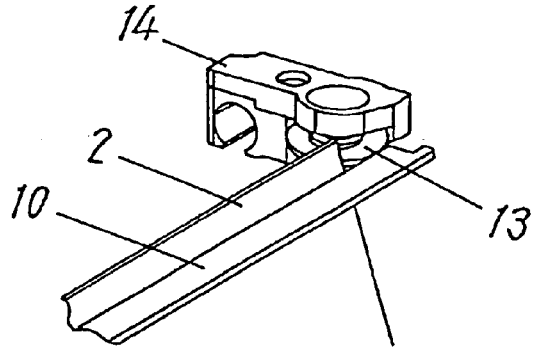
FIG. 5 is a perspective view of the movable blade of the printer shown in FIG. 1.
Figure 6:
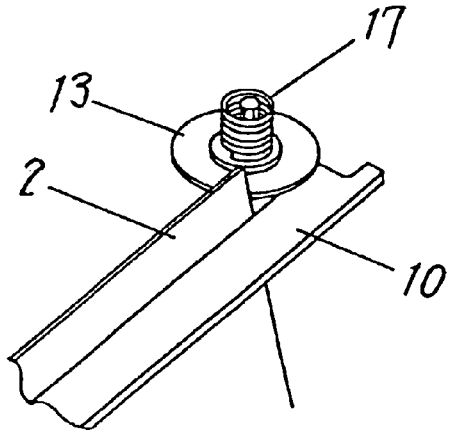
FIG. 6 is a perspective view of the movable blade of the printer shown in FIG. 1.
Figure 7:
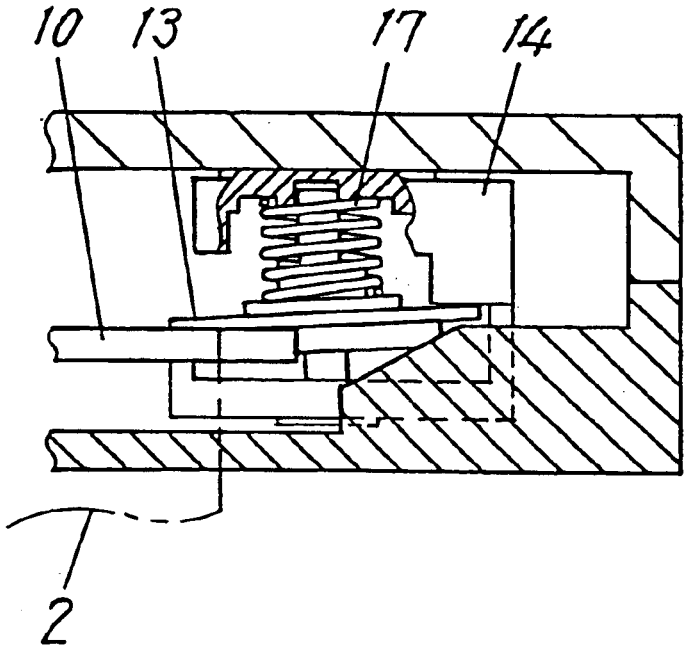
FIG. 7 is a sectional view of the movable blade of the printer shown in FIG. 1.
Figure 8:
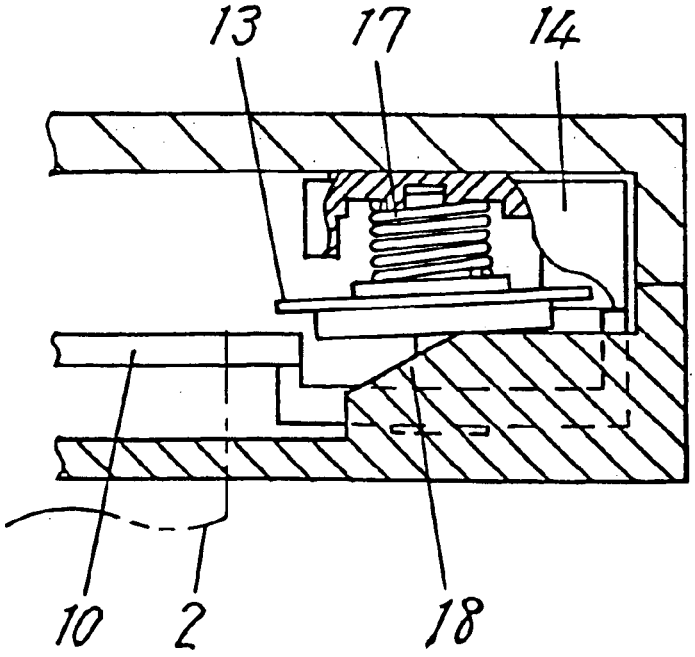
FIG. 8 is a sectional view of the movable blade of the printer shown in FIG. 1.

That is, as shown in FIG. 8, the movable blade 13 stays in the standby position outside the stationary blade 10, and is actuated by spring 17 against the upper surface of the stationary blade 10 outside the end of printing sheet 2 as shown in FIG. 7, FIG. 5 and FIG. 6. Thus, the movable blade 13 moves from the standby position while sliding on the surface of the stationary blade 10.

And in this way, the printing sheet 2, after printing at the printing section 6, is cut and separated by the sheet cutting means 7 comprising these stationary blade 10 and movable blade 13.

In addition, since the stationary blade 10 is disposed at the opening end of the cover 4, the printing sheet 2 is stored in the storage space 3, the end of the printing sheet 2 is brought out of the sheet outlet port 5 until at least reaching the printing section 6 before the cover 4 is closed. Thus, the stationary blade 10 disposed on the cover 4 is opposed to the movable blade 13 at the main body side, composing the sheet cutting means 7. Accordingly, it is possible to simplify the operation to set the printing sheet 2.

Further, since the cover 4 has the stationary blade 10 as a first cutting blade, it is possible to make the cover 4 compact. And thereby, the storage space 3 can be increased in space, and also the cover 4 can be decreased in height.

And, the movable blade 13, at the standby position as shown in FIG. 8, slowly goes up the slope 18 outside the stationary blade 10 and moves thereabove without abutting the stationary blade 10.

That is, the movable blade 13 moves along the stationary blade 10, and the standby position of the movable blade 13 is provided outside the stationary blade 10. Accordingly, the movable blade 13 is at the standby position outside the stationary blade 10 when the cover 4 is opened and closed. Thus, trouble such as collision of the stationary blade 10 and the movable blade 13, impeding the opening and closing operation or giving damage to both blades 10 and 13 may be prevented when the cover 4 is opened and closed.

Also, the movable blade 13 moves up at the standby position. Therefore, when the movable blade 13 moves from the standby position with the cover 4 closed, the movable blade 13 approaches the upper surface of the stationary blade from the up position. Accordingly, even when the position of the stationary blade 10 is slightly changed with the cover 4 closed, the movable blade 13 is able to precisely approach thereto from the up position to smoothly cut the printing sheet 2.

There is provided a spring 17 to actuate the movable blade 13 downward, so that an appropriate relationship may be maintained between the stationary blade 10 and the movable blade 13. Thus, it is possible to smoothly cut the printing sheet 2.

The printing sheet 2 is held and carried between the platen roller 12 and the printing section 6 as a gear (not shown) installed in the main body 1 is engaged with gear 19 fixed to the end of shaft 11 of the platen roller 12.

Industrial Applicability

As described above, the present invention comprises a main body, a storage space for printing sheet, which is disposed in the main body and having a top opening, a cover which is installed at the top opening of the storage space and can be freely opened and closed, a printing sheet stored in the storage space, a sheet outlet port formed between the opening end of the cover and the storage space wall opposing thereto, a printing section disposed below the sheet outlet port, and a sheet cutting means disposed below the printing section, wherein the sheet cutting means comprises a first cutting blade disposed on the opening end of the cover located below the printing section and a second cutting blade disposed on the main body portion opposing to the first cutting blade. Since the first cutting blade included in the sheet cutting means is installed on the opening end of the cover, the printing sheet is stored in the storage space, and the end of the printing sheet is brought out of the sheet outlet port until at least reaching the printing section before closing the cover. In this way, the first cutting blade installed on the cover is opposed to the second cutting blade at the main body side, composing the sheet cutting means. As a result, the printing sheet setting operation can be simplified.

What is claimed is:

1. A printer, comprising:

(a) a main body including a storage space and a printing section; said storage space having an opening, and storing a printing sheet therein, (b) a cover disposed to cover said opening and said printing section of said main body, said cover being installed to be freely opened and closed at said main body, and (c) a sheet cutting mechanism for cutting said printing sheet, said sheet cutting mechanism including a linear sheet cutting mechanism disposed on said cover and a circular sheet cutting mechanism disposed on said main body, said linear sheet cutting mechanism and circular sheet cutting mechanism cutting said printing sheet, wherein said stationary blade has a strip shape, said printing sheet placed along said stationary blade, said circular sheet cutting mechanism has a standby position, in said standby position said circular sheet cutting mechanism is placed at a side direction of said printing sheet, when said movable blade is stood still, said movable blade is placed at said standby position, when said movable blade is moved, said movable blade is movably disposed along a length direction of said stationary blade, said movable blade moves along a side surface of said stationary blade, while said printing sheet is place between said movable blade and said stationary blade, and said printing sheet is cut, wherein circular sheet cutting mechanism further includes a spring mechanism, when said movable blade moves, said spring mechanism pushes said movable blade to said side surface of said linear sheet cutting mechanism, wherein said main body further includes a slope, said slope is disposed at a place opposing said standby position, said movable blade is pushed to said slope by said spring mechanism, moves along said slope, and contacts to said side surface of said stationary blade.

2. The printer of claim 1, wherein said circular sheet cutting mechanism is installed opposing said linear sheet cutting mechanism, and said printing sheet stored in said storage space flows to said printing section.

3. The printer of claim 1, wherein said linear sheet cutting mechanism is disposed at an opening end of said cover.

4. The printer of claim 1, wherein said linear sheet cutting mechanism includes a stationary blade fixed to said cover having a length longer than the width of said printing paper, said circular sheet cutting mechanism includes a movable blade movably disposed in said main body, said stationary blade and said movable blade cut said printing sheet, by moving of said movable blade.

5. The printer of claim 1, wherein said movable blade is placed at a place separated from an end of said stationary blade, when said movable blade is stood still at said standby position.

6. The printer of claim 5, wherein said movable blade is placed at a place separated from said side surface of said stationary blade when said movable blade is stood still at said standby position.

7. The printer of claim 1, wherein a sheet outlet port is formed at a space between an end of said storage space and an inner surface of said cover, and said printing sheet stored in said storage space flows to said sheet outlet port and said printing section.

8. A printer, comprising:

a main body including a storage space, a printing section, and a slope, said storage space having an opening, and storing a printing sheet therein;

a cover disposed to cover said opening and said printing section of said main body, said cover being installed to be freely opened and closed at said main body; and a sheet cutting mechanism for cutting said printing sheet, said sheet cutting mechanism including a first sheet cutting mechanism disposed on said cover and a second sheet cutting mechanism disposed on said main body;

wherein;

said first sheet cutting mechanism has a stationary blade fixed to said cover, said stationary blade is a strip shape having longer length than a width of said printing sheet, and said printing sheet is placed along said stationary blade;

said second sheet cutting mechanism includes a movable blade movably disposed in said main body and a spring mechanism;

said second sheet cutting mechanism has a standby position which is placed at a side direction of said printing sheet, separated from an end of said stationary blade;

said slope of said main body is disposed at a place opposing said standby position of said second sheet cutting mechanism such that when said movable blade moves;

said spring mechanism pushes said movable blade to said slope by said spring mechanism, said movable blade moves along said slope, and contacts to said side surface of said stationary blade;

said spring mechanism pushes said movable blade to said side surface of the stationary blade;

said movable blade moves along a side surface of said stationary blade, while said printing sheet is place between said movable blade and said stationary blade; and said printing sheet is cut; and when said movable blade is still, said movable blade is placed at said standby position.

* * * * *

UNITED STATES PATENT AND TRADEMARK OFFICE

CERTIFICATE OF CORRECTION

PATENT NO. : 6,793,423 B1
DATED : September 21, 2004
INVENTOR(S) : Saito et al.

It is certified that error appears in the above-identified patent and that said Letters Patent is hereby corrected as shown below:

Title page,
Item [22], PCT Filed, "Oct. 20, 2000" should be -- Nov. 20, 2000 --.
Item [86], §371(c)(1), (2), (4) Date, "Oct. 19, 2001" should be -- Oct. 18, 2001 --.

Signed and Sealed this

Twenty-third Day of August, 2005

JON W. DUDAS
*Director of the United States Patent and Trademark Office*